United States Patent [19]

Stolle et al.

[11] 4,320,547

[45] Mar. 23, 1982

[54] PUNCH AND BINDING MACHINE

[75] Inventors: William H. Stolle, Belmont; John C. Duderstadt, San Francisco, both of Calif.

[73] Assignee: Mike Roberts Color Productions, Berkeley, Calif.

[21] Appl. No.: 99,419

[22] Filed: Dec. 3, 1979

[51] Int. Cl.[3] ..... B42F 3/04

[52] U.S. Cl. ..... 11/1 AC; 11/1 R; 83/549

[58] Field of Search ..... 11/1 R, 1 A, 1 B, 1 AC; 83/549

[56] References Cited

U.S. PATENT DOCUMENTS

| | | | |
|---|---|---|---|
| 2,334,589 | 11/1943 | Spinner | 11/1 AC |
| 2,854,679 | 10/1958 | Widell | 11/1 AC |
| 3,016,807 | 1/1962 | Kerr | 53/566 X |
| 3,475,775 | 11/1969 | Staats | 11/1 AC |
| 3,761,983 | 10/1973 | Staats | 11/1 AC |
| 3,881,298 | 5/1975 | Griner et al. | 53/566 X |
| 4,023,722 | 5/1977 | Grushon | 227/65 X |
| 4,129,913 | 12/1978 | Pfaffle | 11/1 A |

FOREIGN PATENT DOCUMENTS

| | | | |
|---|---|---|---|
| 2230822 | 9/1978 | Fed. Rep. of Germany | 11/1 AC |

*Primary Examiner*—Paul A. Bell
*Attorney, Agent, or Firm*—Phillips, Moore, Weissenberger, Lempio & Majestic

[57] ABSTRACT

A punch and binding machine binds material into a booklet with a plastic comb-binding in one continuous operation. The machine combines a conventional multiple hole punch with a uniquely designed binder. A conveyor system moves the material first to the punch machine and then to the comb-binder where an auxillary conveyer moves the material into an opened comb-binding so that the extended fingers of the comb-binding may be released to bind the material into a booklet.

24 Claims, 22 Drawing Figures

FIGURE 4
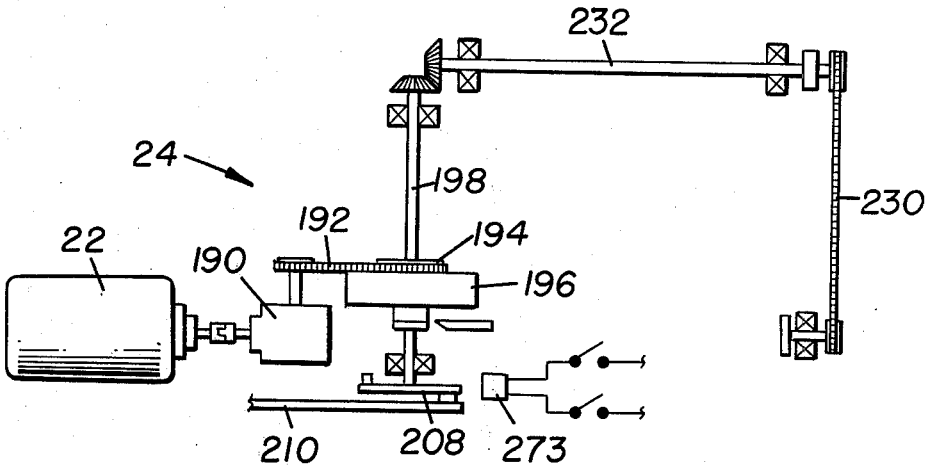
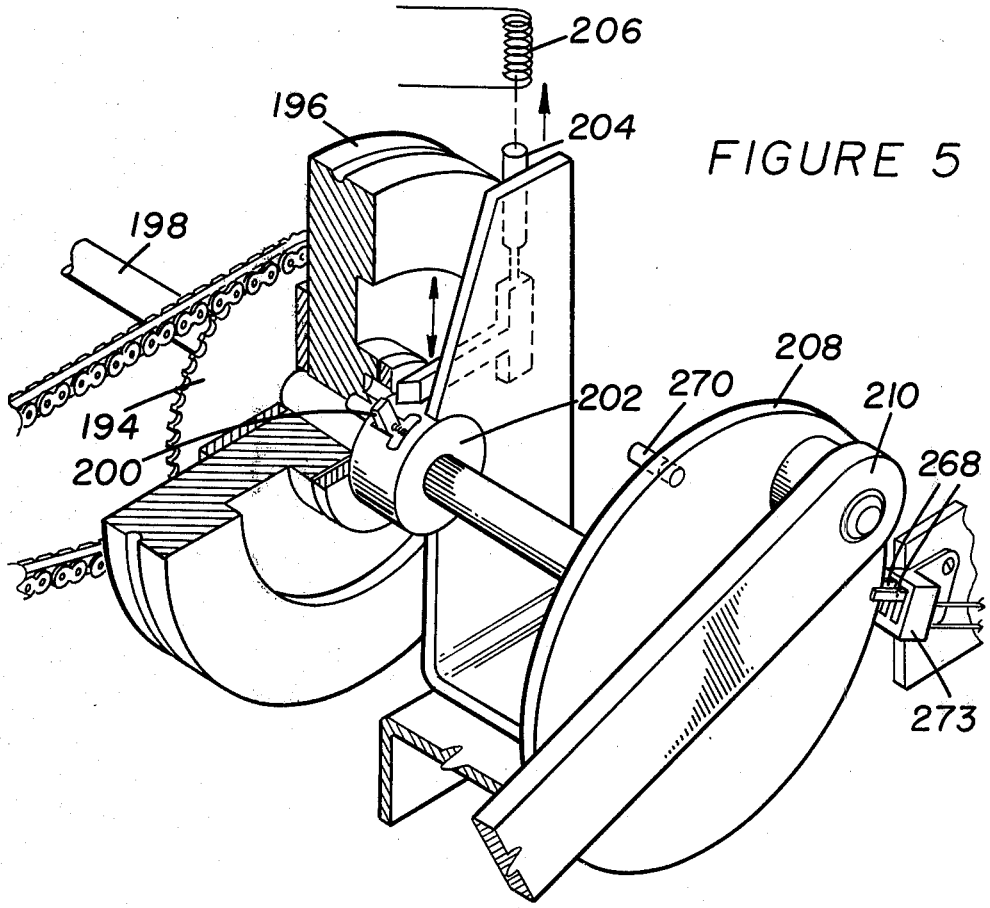
FIGURE 5

28
36
34
70
70
70
50
50
68
16
46
38
26
32
28
30
54
62
62
58
48
28
40
156
50
15
15
60
64
66
62
62
64
56
86
52
70
72
82
76

FIGURE 19
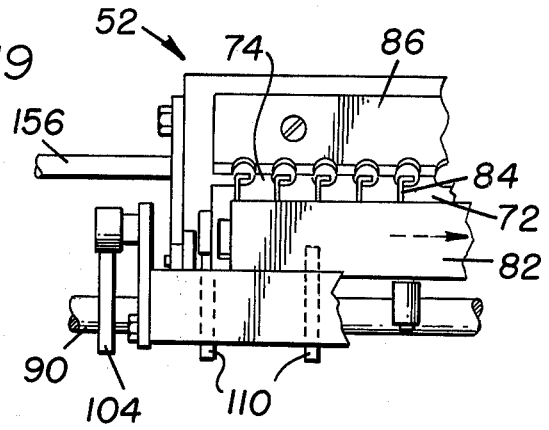
FIGURE 20
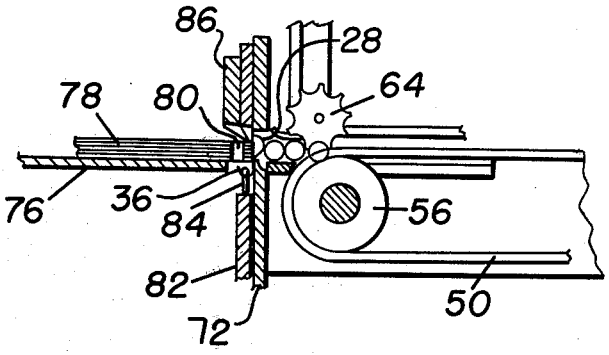
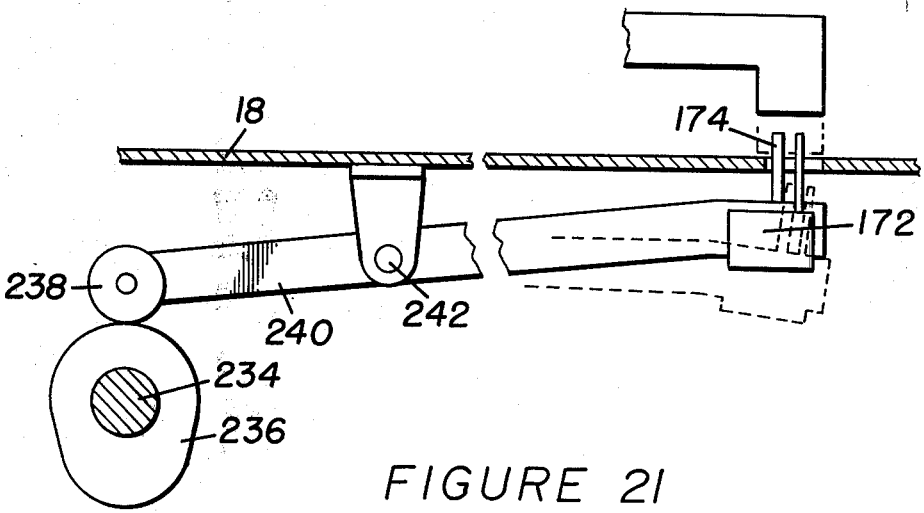
FIGURE 21

PUNCH AND BINDING MACHINE

BACKGROUND OF THE INVENTION

This invention relates to the binding of the material into a booklet or the like. In particular, it relates to an automated machine which receives a plurality of leaves or pages for formation into a booklet. The pages are punched and then moved to a binder where a plastic comb binding is inserted in the punched holes to make a booklet.

Punches and binders for assembling material into booklet form are relatively well-known in the art. For example, U.S. Pat. No. 4,008,501 issued Feb. 22, 1977 to James W. Cutter describes an electrically actuated punching and binding apparatus. This particular device combines a multiple hole punch with a portable binding machine for inserting pre-curled plastic comb-binding elements in the punched material. The machine is power driven but requires the user to insert the material in the punch. The material is then manually moved from the punch to the binding portion of the machine. Before binding the material a pre-curled plastic comb-binding element is manually placed on the comb of the binding machine so that the hook-like protrusions of the machine can open the binding for insertion into the booklet.

Other punching and binding machines disclose generally the same principle as set forth in the Cutter patent while failing to overcome the inherent drawbacks of the Cutter machine. Specifically, the Cutter machine requires manual insertion of the material in the punching portion of the machine and further manual insertion of the material in the binding portion of the machine. Furthermore, the individual pre-curled plastic comb-binding elements must be pre-positioned on the comb before the booklet can be bound. Although the Cutter machine and those similar to the Cutter machine serve adequately in the office environment where small quantities of booklets are prepared, they are deficient in the production environment where large quantities of material are prepared for distribution and subsequent sale. Furthermore, the intended use of the Cutter machine has dictated a relatively light-weight machine which would not stand up under continuous usage.

Accordingly, it is appropriate to design a production machine which combines the punch and binding in one sequential operation wherein material to be bound may be fed to the machine at one end and bound material received from the machine at the other end. Furthermore, it is appropriate to design the binding portion of the machine such that individual comb-binding elements are automatically fed to the binding machine.

SUMMARY OF THE INVENTION

It is therefore an object of the present invention to overcome one or more of the problems set forth above. In one aspect of this invention a punch and binding machine for binding material includes a multiple hole punch and a comb-binding device. A conveyor system is provided to move materials to be bound sequentially to the multiple hole punch and subsequently to the comb-binding device to insert a comb-binding into the material.

The present invention provides an automated punch and binding machine eliminating the problems of earlier machines, particularly the problem of having to hand feed the punch and the binding portions manually. The present machine requires the feeding of the material into the conveyor system so that automatic punching and binding is accomplished without human intervention.

BRIEF DESCRIPTION OF THE DRAWINGS

FIG. 4 is a plan view, partially schematic, of the drive system for the motivating arms.

FIG. 5 is a detailed view of the clutch for the motivating arms.

FIG. 19 is a portion of the spreader shown in FIG. 17 with the jaws closed.

FIG. 20 is a sectional view of the spreader with a comb binding in position.

FIG. 21 is a view partly in section of the activating micro switch.

DETAILED DESCRIPTION OF THE PREFERRED EMBODIMENT

GENERAL

Figures 1, 2:
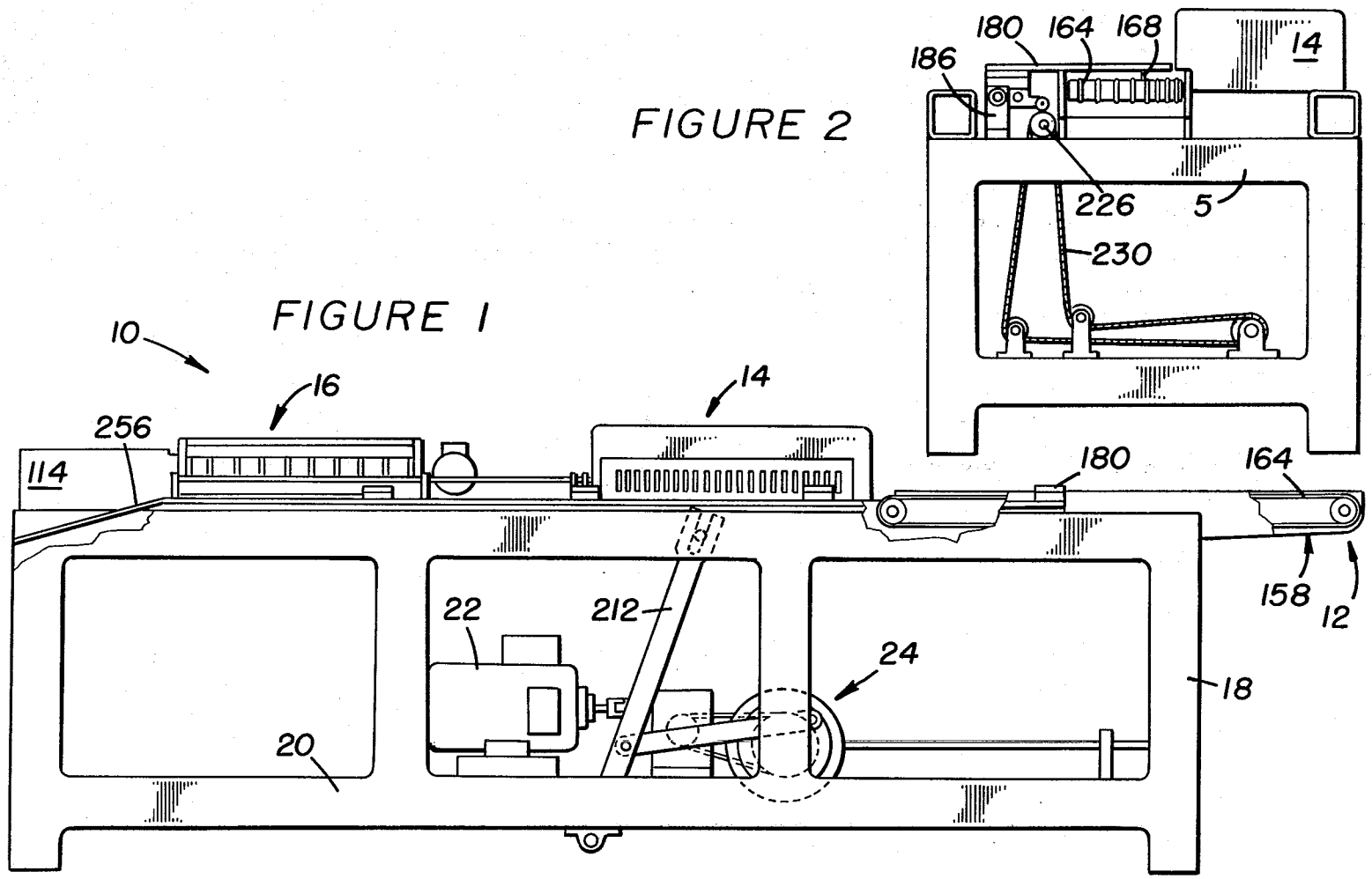
FIG. 1 is a side elevation of the present invention embodying a punch and a machine binding machine with a conveyor system.
FIG. 2 is an end elevation view of the machine depicted in FIG. 1.

FIG. 1 illustrates the overall configuration of a punch and binding machine 10, which is the subject of this invention. Punch and binding machine 10 comprises a conveyor system 12 which feeds material to a multiple hole punch 14, where the material is punched with a plurality of holes. Subsequently, the material to be bound is moved by the conveyer system 12 to a binding device 16, where a precurled plastic comb-binding element has been opened so that the fingers of the comb-binding may be inserted in the holes formed in the material by the multiple hole punch 14. The aforedescribed elements are mounted on a table 18 that has mounted on a lower portion 20, a power source such as the electric motor 22. Associated with electric motor 22 is a power transmission section 24 (shown schematically in FIG. 4). Power transmission section 24 is primarily to operate the conveyor system 12 but has associated therewith various controls, selenoids, micro-switches and the like that operate the individual units such as the multiple hole punch 14 and the binding device 16. These various control elements will become more apparent in the description that follows.

THE MULTIPLE HOLE PUNCH

Having described the general configuration of the multiple hole punch and binding machine 10, each component will be described separately. Since the multiple hole punch 14 is commercially available from NSC International Corporations of Hot Springs, Arkansas, no detailed description of that particular element will be undertaken. It should be noted that some modification of multiple hole punch 14 may be necessary in order to operate it in a continuous mode. Particularly, heavy-duty die-plates and punches may be necessary. Additionally, the power supply must be wired through the main bus of punch and binding machine 10.

THE BINDING MACHINE

Figure 3:
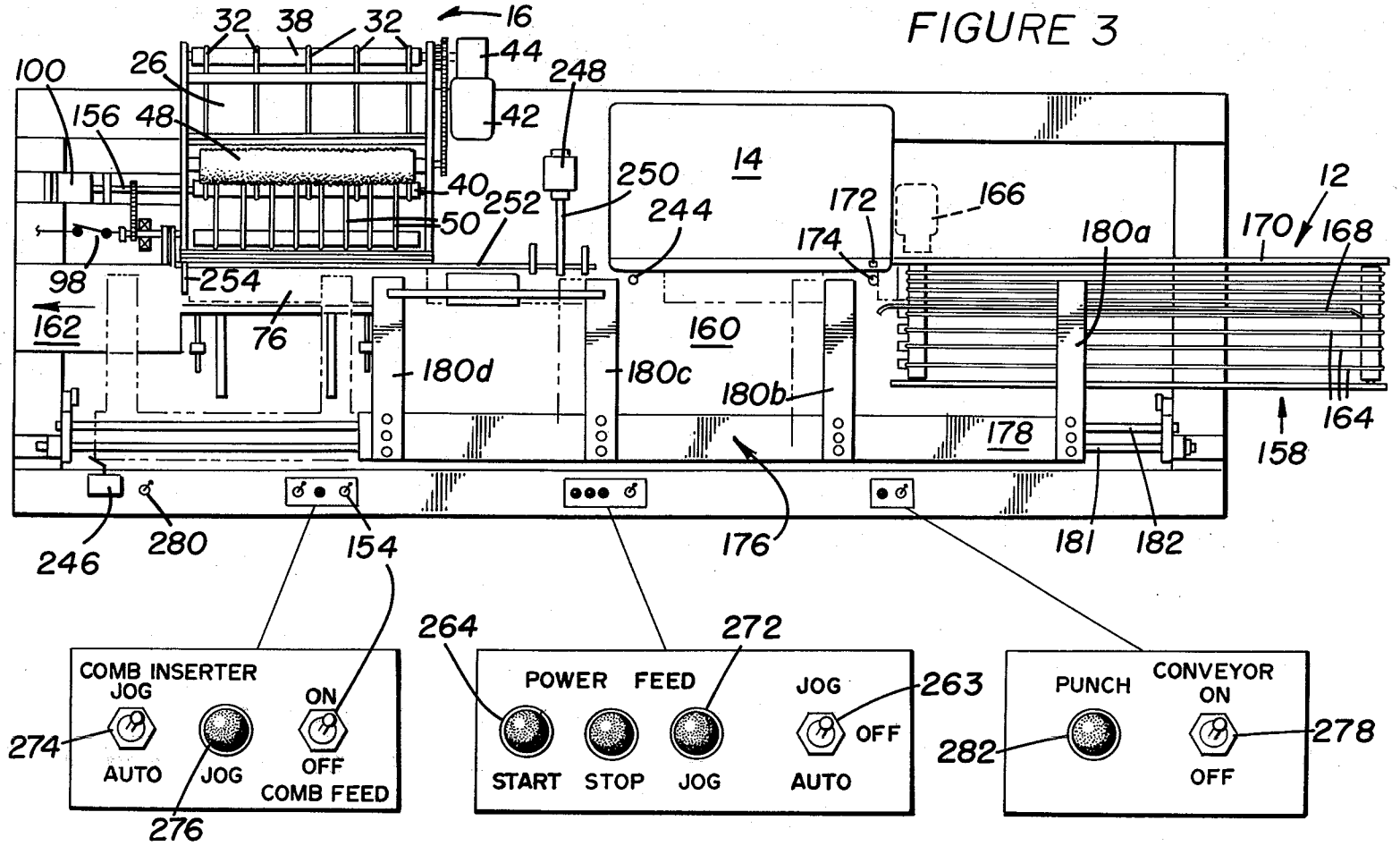
FIG. 3 is a plan view of the machine depicted in FIG. 1.
Figure 7:
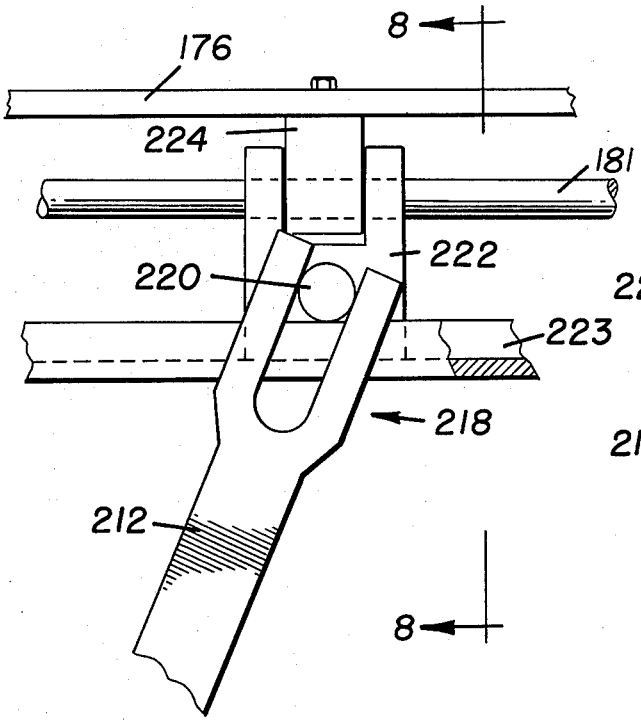
FIG. 7 is a detail of a portion of the power transmission system.
Figure 8:
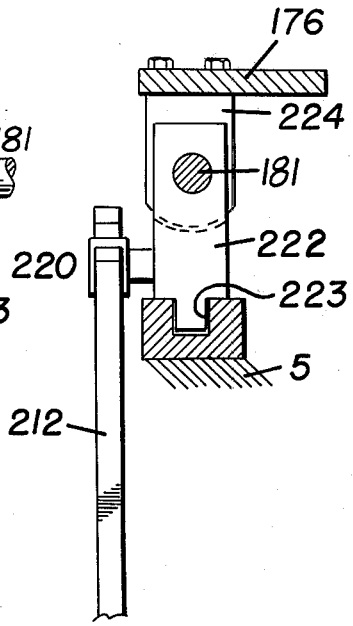
FIG. 8 is a view in cross-section of the power transmission system shown in FIG. 7, taken at section line 8—8.
Figures 11, 15:
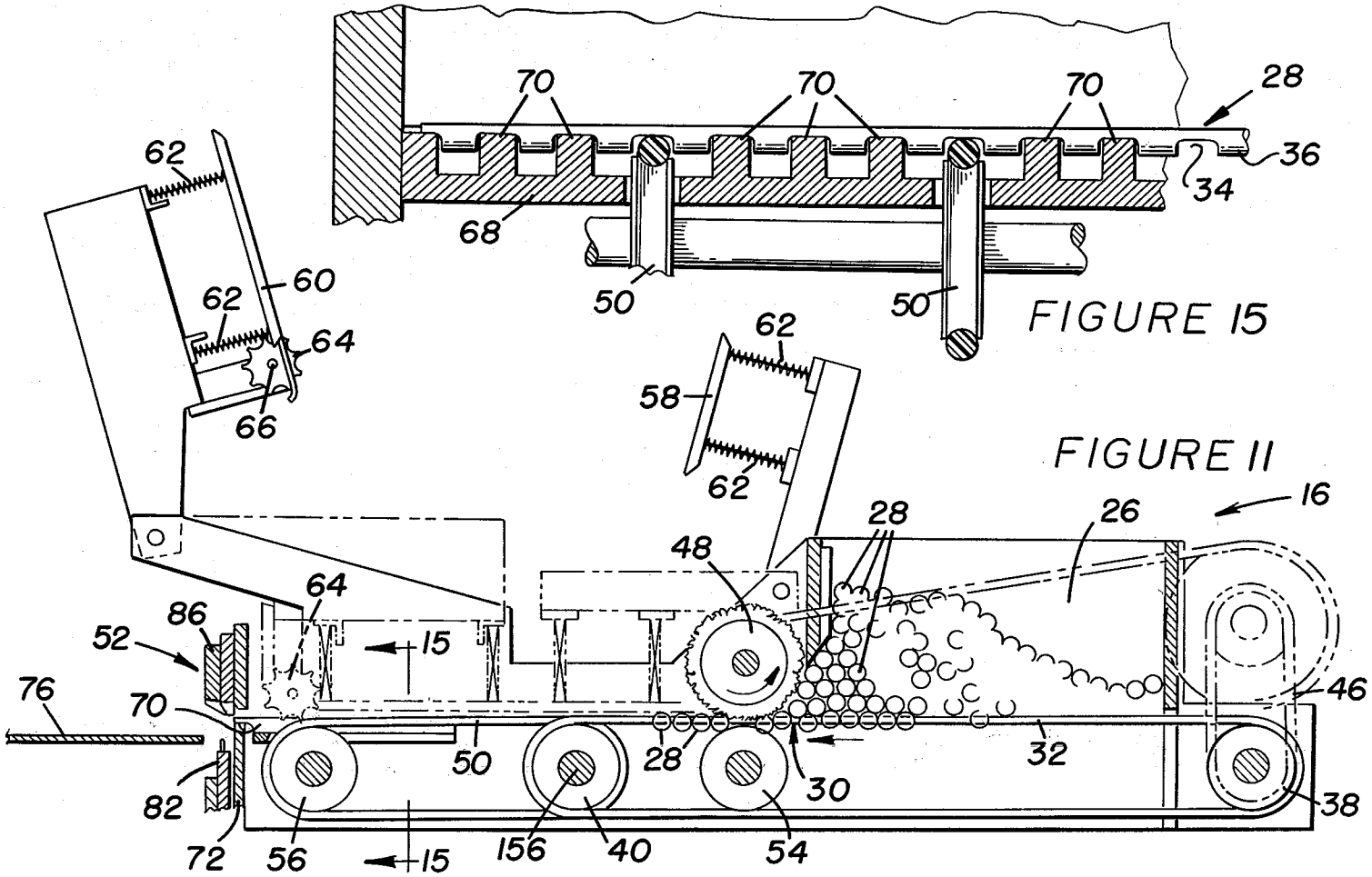
FIG. 11 is a side view of the binding element feed system shown partly in section.
FIG. 15 is a sectional view of the binding element feed system taken at section 15—15 of FIG. 11.

The binding machine 16 is shown in section in FIG. 11. Referring to FIG. 3 and FIG. 11, it will be seen that a bin 26 is formed to receive a plurality of comb-binding elements 28. The comb-binding elements 28 are discharged through a transverse opening 30 in bin 26 so that individual comb-binding elements 28 may be carried to the left as indicated in FIG. 11 by spaced apart conveyors 32. For a better understanding of the structure of the comb-binding elements 28 reference should be made to FIG. 15 wherein it can be seen that the individual comb-binding elements 28 have an overall tubular shape with spaced apart cut-outs 34 formed therein. Each intervening portion or finger 36 extends around and overlaps the upper portion on the back side of the element 28. The comb-binding element 28 is made of a plastic material so that the intervening portion may be pulled or separated from the comb-binding element 28 to open the element in order to bind together material. These comb-binding elements are well known in the art. Any further description is not considered necessary. Suffice it to say that the comb-binding element 28 will adjust itself upon leaving feed bin 26 to ride leftwardly on the conveyors 32 so that the cut-out portions will coincide with the conveyors. Each individual conveyor 32 is preferably an elastomeric belt driven by pulleys 38 and 40. Referring to FIGS. 3 and 11 it can be seen that pulley 38 is powered by the motor 42 through a gear box 44 and a belt 46.

As the individual comb-binding elements 28 are drawn outwardly of bin 26 as described above a roller 48 rotating counter to the flow of comb-binding elements 28 and having a fleece-like cover acts to limit the number of individual comb-binding elements 28 to a single layer on the conveyors 32. An idler 54 is located under roller 48 to provide a degree of rigidity to conveyors 32. After passing idler 54, a second series of conveyor belts 50 picks up the plurality of comb-binding elements 28 to feed them to the comb-binder spreader 52. The conveyors 50 run between pulleys 40 and 56 and are intermittently driven by a motor 88 (see FIG. 17). A further understanding of this intermittent drive will be developed in the ensuing discussion. It should be noted that counter-rotating roller 48 is positioned substantially opposite pulley 54 to act as a limit to the action of the counter-rotating roller to impede individual comb-binding elements from passing thereby. It should be also noted that there are preferably more conveyors 50 than there are conveyors 32.

Positioned over the second portion of the binding machine are pressure plates 58 and 60 (shown raised in FIG. 11). Each pressure plate 58 and 60 is spring biased downwardly by helical springs 62. It should be noted that the pressure plates 58 are hingedly affixed to the binding machine and are shown in the down position in phantom in FIG. 11. It can be seen from this phantom view the individual comb-binding elements 28 pass underneath the pressure plate 58 and 60 in their progress toward the comb-binder spreader 52. Associated at the outward end of pressure plate 60 is a plurality of cogged wheels 64 (only one shown in FIG. 11) which are free to rotate on an axle 66. The plurality of cogged wheels 64 assist in aligning the individual comb-binding elements 28 as they approach the comb-binder spreader 52 and limiting the number of elements 28 reaching the spreader. The cogged wheels also assist in preventing a jam up of a plurality of comb-binding elements 28 as they pass outwardly from pressure plate 60. It should be apparent to those skilled in the art that what has been described to this point is a means for taking a plurality of comb-binding elements 28 located in a bin and feed them one at a time to a comb-binder spreader.

Figure 14:
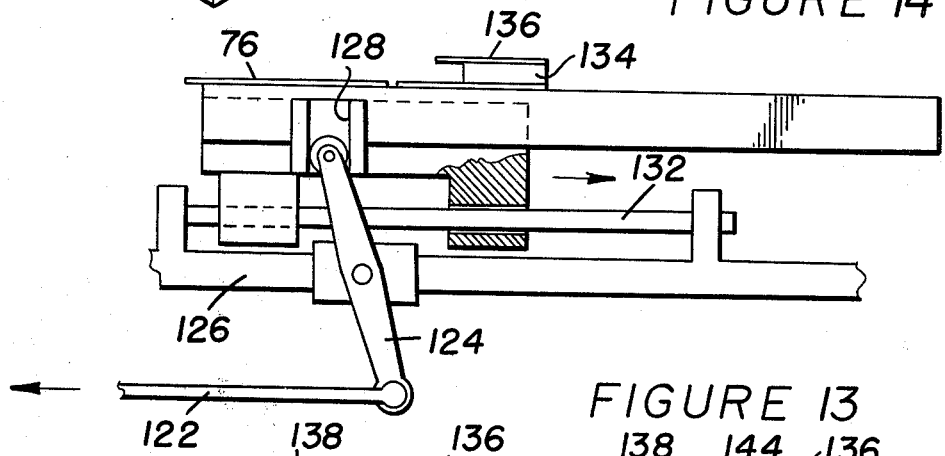
FIG. 14 is a view partly in section of the drive mechanism for the feed system taken at section line 14—14 of FIG. 12.

In order to better understand the spreading operation reference should be made to FIG. 15 where an individual comb-binding element 28 is shown riding on the conveyors 50. At this point the comb-binding element 28 has also reached the point in the machine where a dentated plate 68 having a plurality of upstanding teeth 70 is positioned. The cut-out portions 34 of the individual binding elements 28 ride on the upstanding teeth 70 as indicated in FIG. 14 toward the cogged wheel 64. The upstanding teeth 70 act as a final alignment means for the individual binding elements as they approach the comb-binder spreader.

Figure 17:
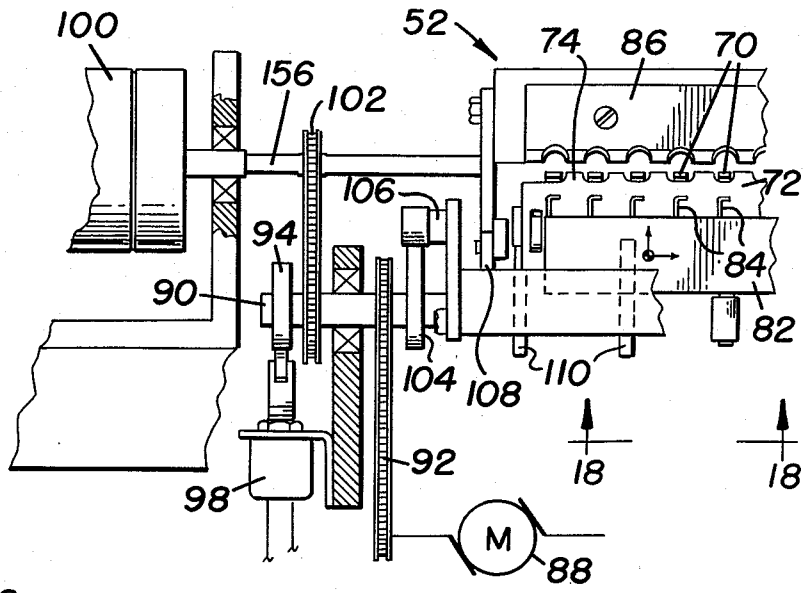
FIG. 17 is a front view of the comb-binding spreader.

Referring now to FIG. 17, a front view of the binder machine shown in FIG. 11, a second dentated plate 72 is seen having a plurality of upstanding teeth 74 which correspond generally to the gaps between teeth 70 of dentated plate 68. Teeth 74 serve to hold back individual comb-binding elements 28 as they are transported toward the left as shown in FIG. 11.

Figure 12:
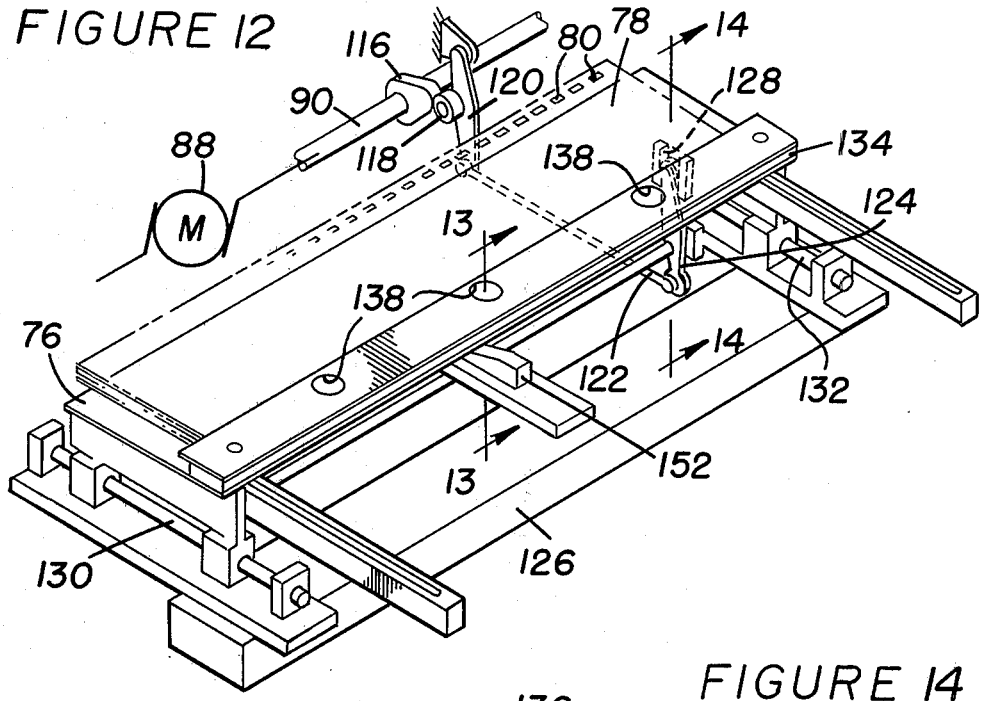
FIG. 12 is a perspective view of the feed system for the binder.

It should be pointed out that what has been described is the feed mechanism for the individual comb-binding elements. Those skilled in the art will understand that simultaneously material is being fed by conveyor system 12 to the binding device 16 and in particular to a feed tray 76 shown in FIG. 12 and in part in FIG. 11. The packet of material or the booklet 78 is shown in FIG. 12 with a plurality of punched holes 80 through which the individual fingers 36 of the comb-binding element 28 will pass. It should be further understood that feed tray 76 moves transversely of conveyor system 12 to move the booklet 78 into an opened comb-binding element 28 as shown in FIG. 20. This will become more apparent in the discussion which follows. Disposed in front of dentated plate 72 is a second plate 82 which is movable upwardly and downwardly and leftwardly and rightwardly as shown in FIG. 17. Second plate 82 has a plurality of hook like extensions 84 which extend upwardly therefrom. Plate 82 with the hook like extensions 84 is movable upwardly so that the hook like extensions can pass into the cut-outs 34 of an individual comb-binding element 28. Plate 82 is then movable rightwardly so that each hook like extension passes into a cylindrical portion formed by a finger 36 of the comb-binding element. Subsequently plate 82 is movable downwardly to extend the cylindrical portions or fingers 36 into finger like protrusions. This is best seen in FIG. 20 wherein the hooks 84 have extended the comb-binding downwardly. At this point the booklet 78 is moved into position so that plate 82 which is now in the downward position as shown in FIG. 17, is movable leftwardly to release the fingers so that they pass upwardly into the holes 80 of the material to be bound. It should be noted that in previous binding machines, such as that described in U.S. Pat. No. 4,008,501, the hooks 84 remain stationary while the comb-binding element was moved on to the hooks. Once the comb-binding element is on the hooks, either the comb-binding element is moved away from the hooks or the hooks removed from the comb-binding element to open the element for subsequent binding.

Prior to plate 82 moving upwardly as just described, a comb 86 moves downwardly to the position shown in FIG. 19 overlapping the upper portion of a comb-binding element 28 as shown in FIG. 20. Simultaneously plate 72 is moved downwardly to remove any obstruction to the incoming booklet 78. The comb 86 serves to hold the individual comb-binding elements during the binding process.

The mechanism which performs the functions of moving the various plates and the comb is best illustrated in FIGS. 16, 17, 18 and 19. In particular motor 88 drives a camshaft 90 by means of an appropriate drive mechanism such as drive chain 92. It should be understood that other means of driving cam shaft 90 may be utilized for example belts or gearing. Mounted on camshaft 90 is a first cam 94 having a single lobe 96 operable to open a normally closed microswitch 98. More will be said about microswitch 98 in a discussion of the circuitry associated with this invention, however at this time suffice it to say the opening of microswitch 98 initiates action to stop the binding process for the particular group of documents or booklet 78 located in the binding machine and further actuates a brake 100. Brake 100 acts through a chain 102 drivingly connected to shaft 90 to stop rotation of shaft 90 and consequently motor 88. It should be apparent to those skilled in the art that motor 88 is activated for a sufficient period to cause one revolution of cam 94 during each sequential binding operation.

Figure 18:
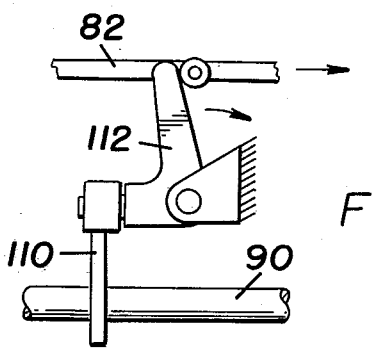
FIG. 18 is a detailed view of the drive mechanism for the comb-binding spreader fingers.
Figure 16:
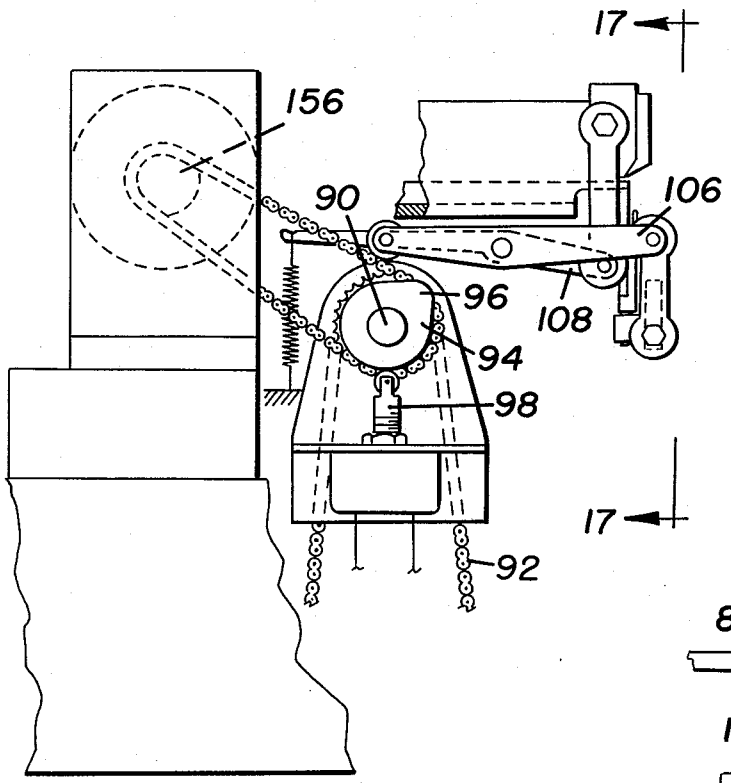
FIG. 16 is an end view of the comb-binding spreader.

A cam 104 mounted on shaft 90 is operable to pivot a lever assembly 106 which works on second plate 82. A second lever assembly 108 is activated by a cam (not shown) to move comb 86 as previously described. It should be noted that cam 104 and the cam that operates the lever assembly 108 are both mounted on shaft 90. A third series of cams 110 also mounted on shaft 90 act on a plurality of bellcranks 112 to move plate 82 and consequently hook like extensions 84 rightwardly as indicated in FIGS. 17 and 18. The exact structure and shape of the various cams just described will of course vary with the size of the comb-binding utilized in this machine, consequently no exact shapes or sizes have been set forth herein. Those skilled in the art should be capable of designing the various cams herein described. The aforedescribed machinery for operating the comb-binder spreader 52 is generally located adjacent the binding device 16 under a cover 114.

Feed tray 76 is also driven by shaft 90 as indicated in FIG. 12. Specifically a cam 116 acting through a cam follower 118 operates a lever 120. Lever 120 is affixed to a pushrod 122 which at its other end is affixed to a lever 124 pivoted to a portion 126 of the frame of the machine. At its other end lever 124 acts in a cam slot 128 affixed to feed tray 76. Feed tray 76 is itself mounted on slide rods 130 and 132 for reciprocal movement. Each rod 130,132 is itself affixed to portion 126 of the frame of the machine. Thus it can be seen that one rotation of shaft 90 results in one reciprocal movement of feed tray 76 backwardly and forwardly of binding device 16.

Figure 13:
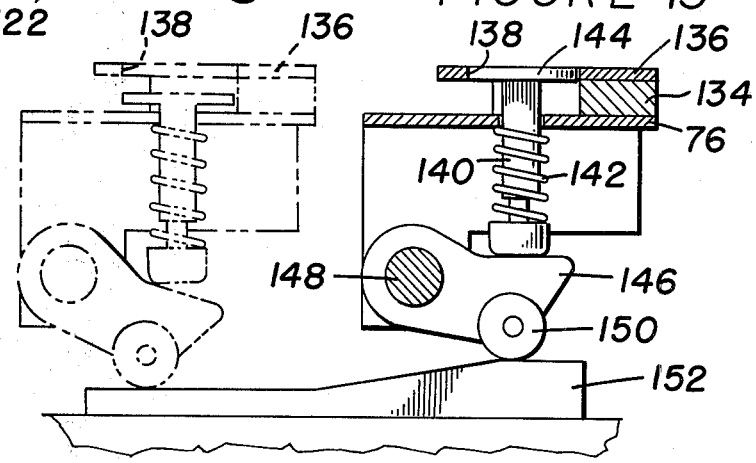
FIG. 13 is a view partly in section of the clamping system associated with the feed mechanism taken at section line 13—13 of FIG. 12.

Feed tray 76 has fitted thereon a spacer block 134 which is slightly thicker than the material to be bound. On top of block 134 is a plate 136 which has a plurality of holes 138 formed therein. Fitted in hole 138 is a flanged plunger 140 which extends downwardly through plate 136, spacer block 134 and feed tray 76 as shown in FIG. 13. Flanged plunger 140 is biased downwardly by helical spring 142. The flange 144 of flanged plunger 140 is formed having an outside diameter slightly smaller than hole 138. A pivoting member 146 is rotatably mounted on a pin 140 affixed to feed tray 76. A cam follower 150 is mounted on pivoting member 146 to follow a ramp cam 152 which is affixed to portion 126 of the frame of the machine. As can be seen in FIG. 13 reciprocal movement of feed tray 76 results in flanged plunger 140 moving upwardly and downwardly. Thus a plurality of papers to be bound positioned on feed tray 76 beneath flanged plunger 140 results in the flange 144 gripping the plurality of papers as feed tray 76 moves inwardly toward comb-binder spreader 52. This same gripping action is in effect as the feed tray moves outwardly from the comb-binder spreader thus insuring the material, which has just been bound, is properly withdrawn from the machine.

Referring again to FIG. 11, the comb feed mechanism should be further understood. Specifically the conveyors 32 may be operated intermittently by actuation of a comb feed switch 154 mounted on the frame of the machine as indicated in FIG. 3. The conveyors 50, on the other hand, are driven by shaft 156 (see FIG. 17). Those pulleys 40 over which the conveyors 32 are run are mounted on bearings on shaft 56 so that conveyors 32 may be operated independently of shaft 156. On the other hand those pulleys 40 over which conveyors 50 are run are affixed for rotation with shaft 156 thus conveyors 50 operate only while motor 88 is running. More will be discussed about this during discussion of the operation of this invention.

THE CONVEYOR

Conveyor 12 is comprised of three major subsections specifically the card feed section 158, the punch and binding section 160 and the discharge section 162. The card feed section 158 is relatively straightforward being comprised of a plurality of flexible belts 164 which are driven by conventional means such as an electric motor 166. It should be noted that adjustable guide 168 is positioned above the plurality of belts 164 and is adjustable for the width of the material being bound.

Referring to FIG. 3 it can be seen that material may be placed on the belts 164 at the righthand end thereof for transport by the belts between guide 168 and a second guide 170 in a leftward direction toward the punch machine 14.

A microswitch 172 is closed by the material approaching punch machine 14 on the conveyors 164. Closing of this microswitch initiates the action to transport the material to be bound to the punch and binding machine by the punch and binding section of the conveyor system. Also located adjacent punch machine 14 is a retractable stop 174 which holds the material to be bound at a position until the punch and binding section of the conveyor system is ready to receive the new material.

Figure 9:
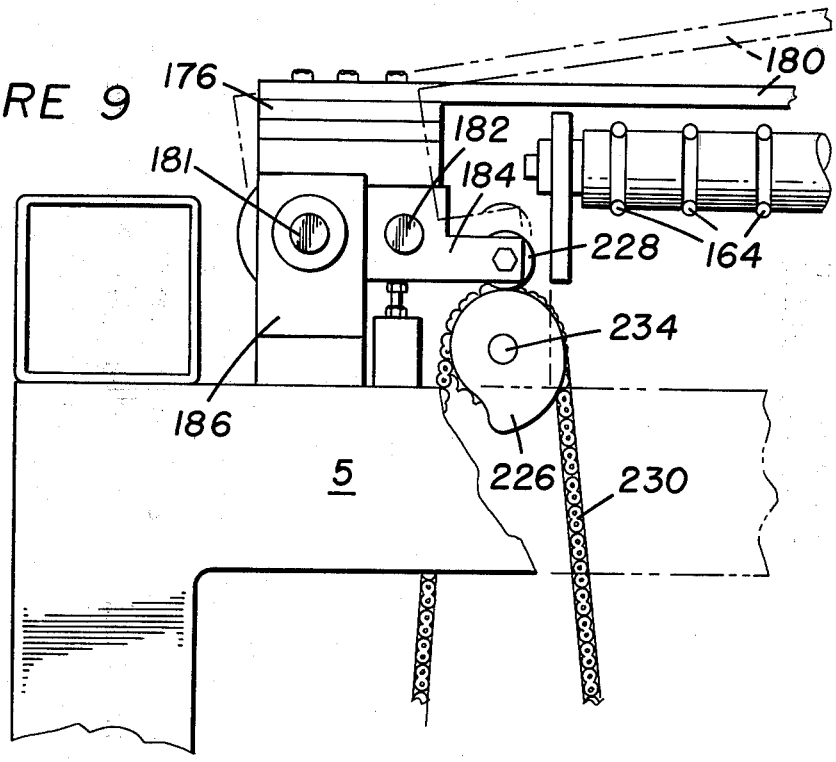
FIG. 9 is a view partly in section of the camming system for raising the motivating arms.

The punch and binding section includes an armed transporter assembly 176 which is driven by electric motor 22. The armed transporter assembly 176 consists of an elongated beam 178 having affixed thereto four arms 180 which extend laterally across the conveyor system. The arms 180 are separated by a distance at least equal to the material which is to be bound. The beam 178 is mounted for longitudinal movement on a pair of slide bars 181 and 182 which extend substantially from the length of the machine as indicated in FIG. 3. Bars 181 and 182 are fitted in a pivotal frame 184 (see FIG. 9) with the bar 181 acting as a pivot member pivoted to an upright 186 which itself is affixed to frame 5 of the basic machine.

The armed transported assembly 176 is moved leftwardly and rightwardly as seen in FIG. 3 by a reciprocating mechanism 188 best illustrated in FIGS. 4 through 8. Reciprocating mechanism 188 is driven by motor 22 through a transmission 190 which in turn drives a drive chain 192. Drive chain 192 turns a sprocket 194 which is affixed to a flywheel 196 both of which are mounted for rotation on a shaft 198. Means for engaging shaft 198 with flywheel 196 are provided by a sliding pin arrangement 200. Pin 200 is slidably mounted in enlargement 202 of shaft 198. Pin 200 is resiliently biased to the engaged position or to the left as indicated in FIG. 5. Movement of the pin 200 to the right will disengage shaft 198 from flywheel 196. Movement of the pin 200 to the right is accomplished by a solenoid arrangement shown schematically in FIG. 5. Specifically a solenoid plunger 204 is moved upwardly upon energizing a coil 206. Coil 206 is actuated by material to be bound contacting of microswitch 172.

Figure 6:
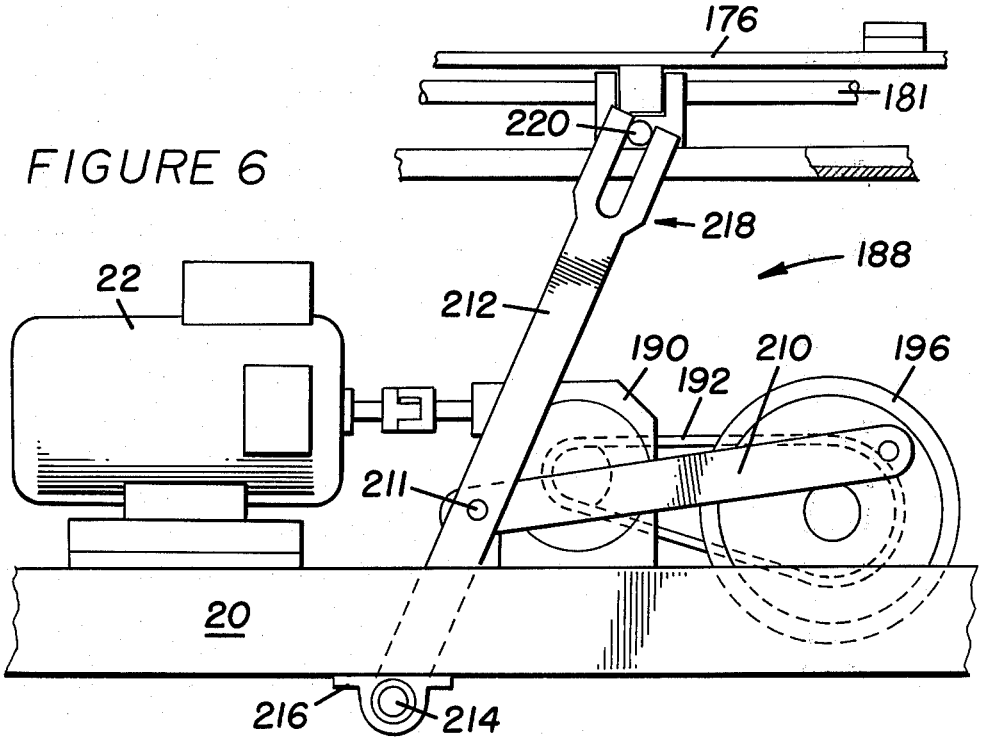
FIG. 6 is an elevation view of the power transmission system for the motivating arms.

Shaft 198 drives an eccentric 208 which has affixed thereto a crank 210. Crank 210 is affixed at its other end by a pin 211 to a lever 212. Lever 212 is pivotally affixed by a pin 214 mounted in a pillow block 216 which in turn is affixed to lower section 20 of table 18. Operation of motor 22 causes lever 212 to move reciprocally leftwardly and rightwardly as indicated in FIG. 6. Lever 212 has formed at its upper end a fork or bifurcation 218 which engages a pin 220. Pin 220 is fitted in a slide 222 which may reciprocate in a groove 223 formed in a portion of frame 5. Slide 222 is itself bifurcated and engages a downwardly projecting portion 224 of armed transporter assembly 176. It should be noted that slide 222 is bored to be received on bar 181 just as downwardly extending portion 224 is bored to be received on bar 181. It should also be noted that the bore in slide 222 and portion 224 is sufficiently large to allow relatively free movement of both slide 222 and portion 224 upon bar 181. It should now be apparent to those skilled in the art that actuation of motor 22 will result in reciprocal movement of armed transporter assembly 76. It should also be apparent to those skilled in the art that during rightward travel (see FIG. 3) of armed transporter assembly 176 that the outwardly extending bars 180 must be lifted off the surface of the conveyor system otherwise material to be bound would not be transported from right to left as is desired.

Figure 10:
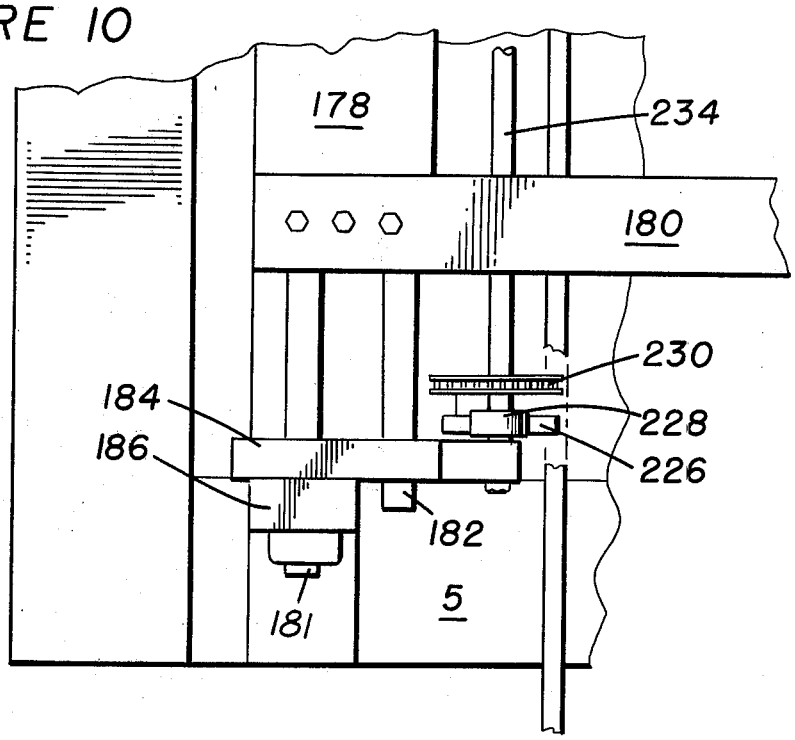
FIG. 10 is a plan view of the camming system shown in FIG. 9.

The lifting action necessary for raising bars 180 is provided by a cam 226. (See FIGS. 2, 9 and 10). Cam 226 acts on the pivoting frame 184, in particular on a cam follower 228 mounted on an extension of pivoting frame 184. Thus rotation of cam 226 raises cam follower 228 or rotates the pivoting frame 184 in a counterclockwise direction to cause the bars 180 to lift upwardly from the table. Cam 226 is driven by a chain 230 which as can be seen in FIG. 4 is driven by shaft 198 through a bevelled gear arrangement and a second shaft 232.

Cam 226 is mounted on a shaft 234 which extends inwardly under table 18 to a second cam 236 which acts on a cam follower 238 mounted on a lever 240. Lever 240 is pivotally associated with table 18 by a pin 242. Lever 240 extends laterally under table 18 and has mounted thereon pin 174 and microswitch 172. Rotation of cam 236 causes lever arm 240 to move in a clockwise direction as shown in FIG. 21 thus retracting pin 174 and microswitch beneath the surface of table 18. This is necessary to permit passage of the material to be bound over stop or pin 174 and microswitch 172.

There exists a second pin 244 extending through table 18 as indicated in FIG. 3 generally at the left end of punch machine 14. Pin 244 is mounted on an extension of arm 240 so that pin 244 is retracted concurrently with pin 174. It should be apparent that material to be bound will first contact microswitch 172 to energize coil 206 and then be stopped at pin 174 until pin 200 engages with flywheel 196 to drive the material leftwardly as indicated in FIG. 3. The material is subsequently stopped at pin 244 for the punch operation. When pin 174 is retracted pin 244 is simultaneously retracted and the material may be picked up by the second arm **180*b*** to be moved to the third position on the binding table.

The discharge section includes a microswitch 246 which is actuated by beam 178 as it moves to its extreme leftward position. Microswitch 246 controls a solenoid 248 positioned generally between the punch machine and the binding machine. Solenoid 248 acts through a lever 250 to rotate a shaft 252. Shaft 252 positions a stop 254 adjacent the left hand of the binding machine 16. Thus material moved in front of the binding machine is stopped by stop 254.

The discharge section of the conveyor system 12 consists of a chute 256 adjacent stop 254. Material positioned in front of the binding machine 16 is moved leftwardly by the leftmost arm of the armed transporter assembly to fall into chute 256 where gravity ensures that it is carried off the machine and into an appropriate receptacle such as a box.

THE CONTROL CIRCUIT

Figure 22:
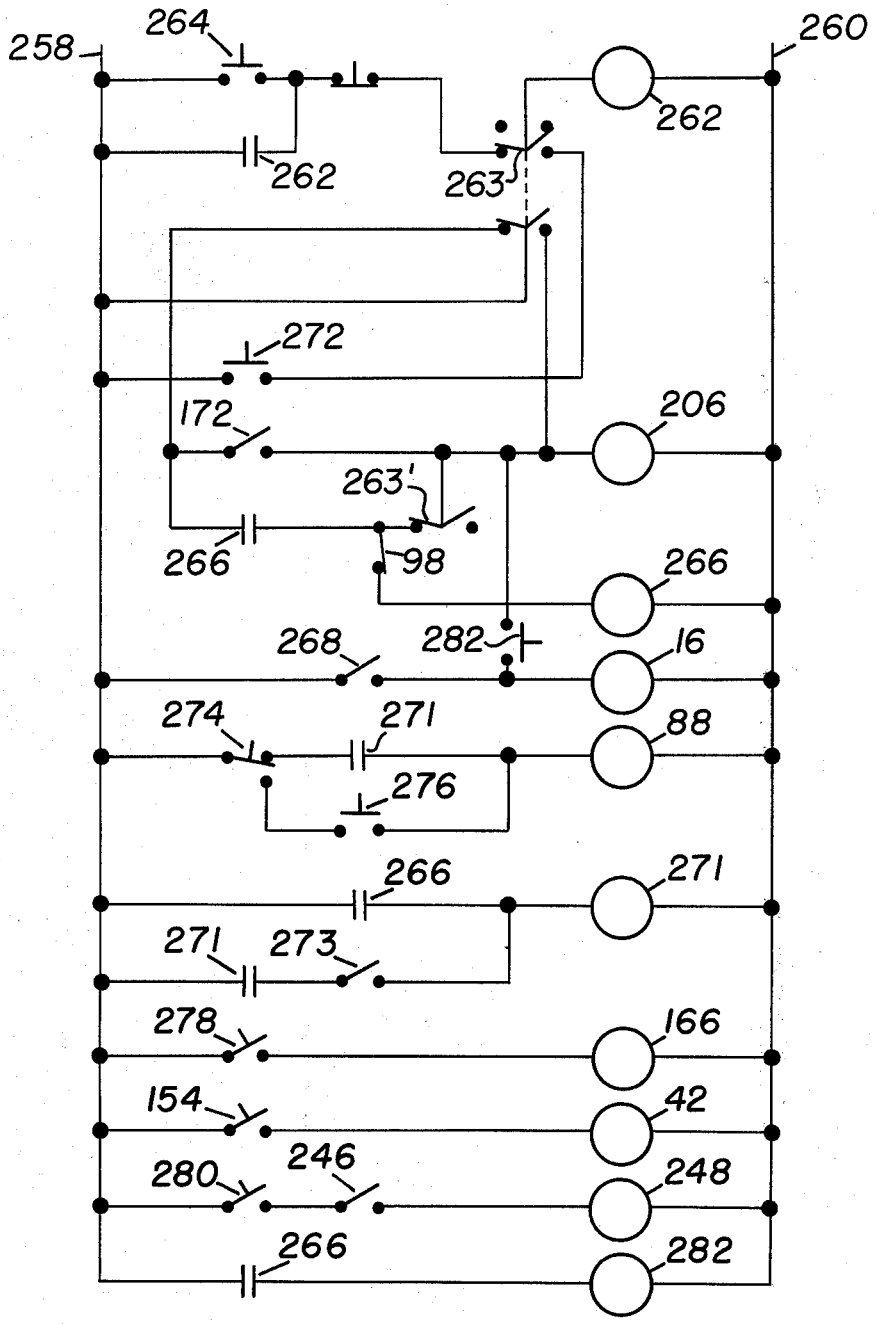
FIG. 22 is a wiring diagram for the power system for operating the punch and binding machine described herein.

The control circuit for the machine is shown in FIG. 22. Alternating current is supplied to the leads 258 and 260 in a conventional manner. The motor 22 is started by a motor starter relay 262. With a switch 263 in the "automatic" position as shown in FIG. 22 relay 262 is energized by momentarily depressing a starter button 264. With motor 262 running and switch 263 in the "automatic" position clutch pin 200 is retracted by the clutch mechanism shown in FIG. 5 so that eccentric 208 is not driven until microswitch 172 is closed. Closure of microswitch 172 results in solenoid 206 being activated thus moving solenoid plunger 204 upwardly permitting pin 200 to engage weighted flywheel 196 for engagement of shaft 198 with flywheel 196. With the closure of microswitch 172 power is supplied through switch 263' to a normally closed microswitch 98 located adjacent the binding machine 16. Power then passes through to energize a first relay 266 to provide a closed circuit to clutch solenoid 206. Thus clutch solenoid 206 remains actuated until contact at microswitch 98 is broken to deenergize first relay 266.

Mounted adjacent eccentric 208 is a normally open microswitch 268 which actuates punch machine 16 at the appropriate time. This is accomplished by a dog 270 affixed at the appropriate position on eccentric 208.

Should it be desirable to utilize the feed mechanism in an intermittent mode, switch 263 is moved to the "jog" position so that a spring loaded jogging switch 272 may intermittently power motor starter 262 simultaneously powering clutch solenoid 206. Thus in intermittent operation clutch solenoid 206 is continuously powered as long as switch 272 is held down.

Inserter motor 88 is operable in the automatic mode only while a relay 271 is energized. Relay 271 is energized only with relay 266 energized and upon closing a normally open microswitch 273, which is located adjacent microswitch 268 and is operable by the same dog 270 on eccentric 201. With microswitch 273 closed and relay 266 energized relay 271 is energized thus permitting power to pass through comb switch 274, relay 271 and energize motor 88. Motor 88 remains operating until the normally closed microswitch 98 breaks the source of power to relay 266. Normally motor 88 remains operable for one revolution of shaft 90. Motor 42 which drives the comb-binding feed mechanism in particular belts 32, is powered by a switch 154 as previously indicated. The conveyor section is powered by a switch 278, while stop solenoid 248 is operated by microswitch 246 as indicated previously. Microswitch 246 may be inactivated by a hand operated switch 280.

Brake 100 remains disengaged as long as a relay 266 is actuated. With relay 266 deenergized, a brake relay 232 is deenergized to engage brake 100 thus stopping shaft 156.

OPERATION OF THE PREFERRED EMBODIMENT

Although operation of the aforedescribed device should be apparent to those skilled in the art a brief description of the operation is offered herewith to provide a better understanding of the overall machine. The material to be bound is fed to the conveyor system at the right hand end on the card feed section 158. One package of material at a time is fed to card feed section 158. Contact with microswitch 172 actuates the punch and binding section 160 and in particular rotates the armed transporter assembly downwardly so that the rightmost arm **180*a* engages the right hand edge of the material to be punched and bound. As the beam 178 moves leftwardly the material moves leftwardly with the arm 180*a* to contact stop 244. When the material reaches stop 244 dog 270 on eccentric 280 actuates microswitch 268 to power the punch machine 14 so that a plurality of holes are punched in the material for subsequent binding. Simultaneously beam 178 is moving rightwardly with the arms 180 raised to pick up the next packet of material. As beam 178 reaches its full rightward position, the arms 180 are lowered so that the second arm 180*b* may pick up the just punched material to move it to a position adjacent solenoid 248. Simultaneously the next packet of material is being moved to the punch machine. No action takes place on the first packet of material that is adjacent solenoid 248** at this time.

On the next or third cycle of beam 178 the material adjacent solenoid 248 is moved leftwardly to the punch machine 16 and onto tray 76 for movement into the punch machine 16. As the material reaches tray 76, the arms 180 are once again raised to move rightwardly to pick up the next groups of material. At that time dog 270 actuates microswitch 273 which in turn actuates inserter motor 88 to move the material on tray 76 into the binding machine.

As the material approaches the binding machine a comb-binding 28 (see FIG. 19) has been positioned so that the hook like extensions 84 can open the fingers of the comb-binding 28 as shown in FIG. 20. When the material 78 is in position the hook like extensions 84 move leftwardly as shown in FIG. 17 to release the fingers thus binding the material. The material is then withdrawn from the binding machine by the tray 76 moving leftwardly as shown in FIG. 11 for subsequent ejection from the machine.

It should be understood that during the binding operation the comb-bindings 28 are fed to the conveyors 50 in the manner described above. It is important that the comb-bindings be separated thus the pressure plates 58 and 60 must remain in the downward position. Furthermore cogged wheels 64 tend to feed one comb-binding at a time to the mouth of the binding machine for action by the hook like extensions 84.

It should be noted again that as the arms 180 are lowered through the cam action of cam 226 the stops 174 and 244 and the microswitch 172 are also lowered to a position below the path of the material being punched and bound. Should microswitch 172 remain in the upward position the clutch would be disengaged upon the next rotation of weighted flywheel 196.

Finally it should be noted that there remains a single punch switch 282 which is operable only with the switch 263 in the jog position. Punch 282 may be used independently of the jog switch 272 as indicated in FIG. 22. In FIG. 22 it should be noted that switch 263 is "ganged" to switch 263'.

Although this invention has been described with respect to a particular embodiment, it should be understood that modifications with and variations to this invention are within the scope and content of the appended claims.

We claim:

1. A binding machine for inserting a comb-binding in a plurality of prepunched sheets comprising:

first holding means for holding said material;

second holding means for holding a comb-binding;

separate means for selectively extending and releasing the fingers of said comb-binding; and feed means for sequentially feeding comb-bindings toward said first holding means, said feed means including a plurality of flexible belts moving toward the first holding means, said driven belts spatially separated one from another a distance equal to a multiple of the separation of the fingers of one of the comb-bindings.

2. The binding machine of claim 1 wherein the feed means includes retarding means for permitting a limited number of comb-bindings to be conveyed by said flexible driven belts to said first holding means.

3. The binding machine of claim 2 wherein the retarding means includes a roller having a relatively soft pliable surface in comparison to the surface of a comb binding.

4. The binding machine of claim 3 wherein the axis of said roller is normal to the direction of travel of the flexible driven belts and rotation of said roller is such that at the closest point of approach of said roller to said flexible driven belts, movement of the surface of the roller is opposite to movement of the flexible driven belts.

5. The binding machine of claim 4 wherein the feed means further includes a feed bin for receiving a plurality of comb-bindings, said feed bin defining an elongated opening adjacent the plurality of flexible driven belts.

6. The binding machine of claim 5 wherein the separate means comprises a plurality of hook-like extensions at least equal to the number of fingers of the comb-binding, and a beam, each of said hook-like extensions mounted on said beam to extend outwardly therefrom, and movement means for (1) moving the plurality of said hook-like extensions in a first direction from a first position to a second position between the fingers of a comb-binding, (2) moving the plurality of hook-like extensions in a second direction normal to said first direction from said second position to a third position into the curled fingers of the comb-binding and (3) moving said hook-like extensions in a third direction parallel but opposite to said first direction from said third position to a fourth position to extend the fingers of a comb-binding.

7. In combination with a multiple hole punch a comb-binding machine comprising:

first holding means for holding said material;

second holding means for holding a comb-binding;

separate means for selectively extending and releasing the fingers of said comb-binding;

conveyor means for moving punched material from said multiple hole punch to said first holding means;

means for moving said first holding means in first and second opposite directions normal to said conveyor means whereby said material is positioned adjacent a spread comb-binding so that a comb-binding may be inserted therein; and feed means for sequentially feeding comb-bindings to said first holding means, said feed means including a plurality of flexible driven belts moving toward said first holding means, said driven belts spatially separated one from another a distance equal to a multiple of the separation of the fingers of one of the comb-bindings.

8. The combination of claim 7 wherein the feed means includes retarding means for permitting a limited number of comb-bindings to be conveyed by said flexible driven belts to said first holding means.

9. The combination of claim 8 wherein the retarding means includes a roller having a relatively soft pliable surface in comparison to the surface of a comb binding.

10. A binding machine for inserting a comb-binding in a plurality of prepunched sheets comprising:

first holding means for holding said material;

second holding means for holding a comb-binding;

separate means for selectively extending and releasing the fingers of said comb-binding;

means for moving said first holding means in first and second opposite directions whereby said material is adjacent a spread comb-binding so that a comb-binding may be inserted; and feed means for sequentially feeding comb-bindings to said first holding means, said feed means including a plurality of flexible driven belts moving toward said first holding means, said driven belts spatially separated one from another a distance equal to a multiple of the separation of the fingers of one of the comb-bindings.

11. The binding machine of claim 10 wherein the separate means comprises a plurality of hook-like extensions at least equal to the number of fingers of the comb-binding, and a beam, each of said hook-like extensions mounted on said beam to extend outwardly therefrom, and movement means for (1) moving the plurality of said hook-like extensions in a first direction from a first position to a second position between the fingers of a comb-binding, (2) moving the plurality of hook-like extensions in a second direction normal to said first direction from said second position to a third position into the curled fingers of the comb-binding and (3) moving said hook-like extensions in a third direction parallel but opposite to said first direction from said third position to a fourth position to extend the fingers of a comb-binding.

12. The binding machine of claim 11 wherein the separate means further includes means for moving a plurality of said hook-like extensions in a fourth direction parallel but opposite to said second direction from said fourth position to said first position, said movement in a fourth direction releasing the fingers of a comb-binding.

13. The binding machine of claim 10 wherein the first holding means comprises:

a plate;

a clamp; and means for opening said clamp on movement of said plate in a first direction toward said second holding means and closing said clamp on movement of said plate in a second direction away from said second holding means.

14. A punch and binding machine for binding material comprising:

a multiple hole punch;

a comb binding device;

conveyor means for sequentially moving said material to be bound to said multiple hole punch to punch said material and to the vicinity of said comb binding device to insert a comb binding into said material;

first holding means for holding said material;

second holding means for holding a comb binding;

separate means for selectively extending and releasing the fingers of said comb binding;

second conveyor means for moving said first holding means in first and second opposite directions normal to said conveyor means with said material held in said first holding means; and feed means for sequentially feeding comb bindings toward said first holding means, said feed means including a plurality of flexible-driven belts moving towards said first holding means, said driven belts spatially separated one from another a distance equal to a multiple of the separation of the fingers of one of the comb bindings.

15. The punch and binding machine of claim 14 wherein the feed means includes retarding means for permitting a limited number of comb-bindings to be conveyed by said flexible driven belts to said first holding means.

16. The punch and binding machine of claim 15 wherein the retarding means includes a roller having a relatively soft pliable surface in comparison to the surface of a comb-binding.

17. The punch and binding machine of claim 16 wherein the axis of said roller is normal to the direction of travel of the flexible driven belts and rotation of said roller is such that at the closest point of approach of said roller to said flexible driven belts, movement of the surface of the roller is opposite to movement of the flexible driven belts.

18. The punch and binding machine of claim 17 wherein the feed means further includes a feed bin for receiving a plurality of comb-bindings, said feed bin defining an elongated opening adjacent the plurality of flexible driven belts.

19. The punch and binding machine of claim 14 wherein the separate means comprises a plurality of hook-like extensions at least equal to the number of fingers of the comb-binding, and a beam, each of said hook-like extensions mounted on said beam to extend outwardly therefrom, and movement means for (1) moving the plurality of said hook-like extensions in a first direction from a first position to a second position between the fingers of a comb-binding, (2) moving the plurality of hook-like extensions in a second direction normal to said first direction from said second position to a third position into the curled fingers of the comb-binding and (3) moving said hook-like extensions in a third direction parallel but opposite to said first direction from said third position to a fourth position to extend the fingers of a comb-binding.

20. The punch and binding machine of claim 19 wherein the separate means further includes means for moving a plurality of said hook-like extensions in a fourth direction parallel but opposite to said second direction from said fourth position to said first position, said movement in a fourth direction releasing the fingers of a comb-binding.

21. The punch and binding machine of claim 14 wherein the first holding means comprises:

a plate;

a clamp; and means for opening said clamp on movement of said plate in the first direction toward said second holding means and closing said clamp on movement of said plate in the second direction away from said second holding means.

22. The punch and binding machine of claim 14 wherein said conveyor means includes a first stop member adjacent said multiple hole punch, a belted conveyor leading to said multiple hole punch and drive arm means for transporting material (1) to said multiple hole punch and (2) to said comb binding device.

23. The punch and binding machine of claim 14 wherein said conveyor means includes microswitch means for providing power to said drive arm means only while material is located on said belted conveyor.

24. The punch and binding machine of claim 14 wherein said conveyor means includes means for selectively accepting material of differing widths.

* * * * *